US010457452B2

(12) United States Patent
Paganuzzi

(10) Patent No.: US 10,457,452 B2
(45) Date of Patent: Oct. 29, 2019

(54) SAFETY CAPSULE FOR A CONTAINER

(71) Applicant: BORMIOLI ROCCO S.P.A., Fidenza (Parma) (IT)

(72) Inventor: Valerio Paganuzzi, Parma (IT)

(73) Assignee: BORMIOLI PHARMA S.P.A., Milan (IT)

( * ) Notice: Subject to any disclaimer, the term of this patent is extended or adjusted under 35 U.S.C. 154(b) by 46 days.

(21) Appl. No.: 15/563,256

(22) PCT Filed: Mar. 30, 2016

(86) PCT No.: PCT/IB2016/051797
§ 371 (c)(1),
(2) Date: Sep. 29, 2017

(87) PCT Pub. No.: WO2016/162777
PCT Pub. Date: Oct. 13, 2016

(65) Prior Publication Data

US 2018/0093802 A1 Apr. 5, 2018

(30) Foreign Application Priority Data

Apr. 10, 2015 (IT) ..... PR2015A0023

(51) Int. Cl.
*B65D 50/04* (2006.01)
*B65D 41/34* (2006.01)

(52) U.S. Cl.
CPC ..... *B65D 50/041* (2013.01); *B65D 41/3428* (2013.01)

(58) Field of Classification Search
CPC ..... B65D 50/041; B65D 50/00; B65D 50/02; B65D 50/04; B65D 41/3428; B65D 41/00; B65D 41/32; B65D 41/34; B65D 41/3423
See application file for complete search history.

(56) References Cited

U.S. PATENT DOCUMENTS 3,968,894 A 7/1976 Herrmann
4,365,722 A * 12/1982 Kramer ..... A61J 7/04 116/308

(Continued)

FOREIGN PATENT DOCUMENTS

CH 583648 A5 1/1977
CN 2207351 Y 9/1995

(Continued)

*Primary Examiner* — Kareen K Thomas
(74) *Attorney, Agent, or Firm* — Pearne & Gordon LLP

(57) ABSTRACT

A safety capsule for a container, comprising: a cap (2) for closing the container, said cap comprising a thread (20) for connection to the container; a cover (3) for said cap (2), said cover (3) comprising a base (30) and a lateral wall (31) that extends from said base (30); said base (30) and said lateral wall (31) overlying said cap (2), said base (30) being at the opposite end with respect to a zone (4) of the capsule that comprises an intactness band (8) designed to be connected with the container; a press-fit engagement means (5) that sets said cap (2) and said cover (3) into operative communication, enabling transmission of motion from the cover (3) to the cap (2) for the purpose of making it possible to unscrew said cap (2); means (6) for preventing extraction of the cover (3) from the cap (2), comprising a first connecting means (61) for connecting the cover (3) to the cap (2) and that extends along a first imaginary annular line; the engagement means (5) and said first connecting means (61) being at least partly incorporated in said cap (2) and cover (3); means (27) for re-closing the cap (2) on the container after it has been opened, and comprising first and second flexible tabs (23, 32) incorporated on the cap (2) and on the cover (3), respectively.

10 Claims, 2 Drawing Sheets

(56) References Cited

U.S. PATENT DOCUMENTS

| | | | | | |
|---|---|---|---|---|---|
| 4,598,833 | A * | 7/1986 | Herr | B65D 50/041 | 215/220 |
| 4,832,218 | A * | 5/1989 | Gibilisco | B65D 50/041 | 215/219 |
| 5,188,251 | A * | 2/1993 | Kusz | A61J 7/04 | 116/308 |
| 5,316,161 | A * | 5/1994 | Gargione | B65D 50/041 | 215/220 |
| 5,678,712 | A * | 10/1997 | Rios | B65D 50/041 | 116/308 |
| 5,762,215 | A * | 6/1998 | Ogden | B65D 50/041 | 215/217 |
| 7,815,061 | B1 * | 10/2010 | Robinson | B29C 45/1676 | 215/220 |
| 8,186,526 | B2 * | 5/2012 | Branson | B65D 50/041 | 215/220 |
| 2004/0045923 | A1 | 3/2004 | Lancesseur et al. | | |
| 2010/0237072 | A1 | 9/2010 | Ahn | | |
| 2012/0138561 | A1 | 6/2012 | Brozell | | |

FOREIGN PATENT DOCUMENTS

| | | | |
|---|---|---|---|
| CN | 2388143 | Y | 7/2000 |
| CN | 101888954 | A | 11/2010 |
| WO | 0228737 | A1 | 4/2002 |

* cited by examiner

SAFETY CAPSULE FOR A CONTAINER

TECHNICAL FIELD

The object of the present invention is a safety (childproof) capsule for a container.

BACKGROUND ART

There are known childproof safety capsules comprising a cap for closing a container and a cover that surmounts said cap.

An axial direction identified by the direction of extension of the neck of the container is defined. For the purpose of enabling the capsule to be opened, the cover must be pushed along this axial direction (so as to mesh said cover and said cap), while also turning the cover in a first direction at the same time (in fact, it has been demonstrated that the coordinated combination of these two movements proves to be particularly difficult for children under the age of 6 years). This prevents children from accidentally gaining access to the contents of the container. Similar applications are typically used for containers designed to contain pharmaceutical products. In safety capsules, the cover serves the function of preventing an outside user from gaining direct access to the cap. This cover further comprises an annular projection that projects towards the cap and engages below an annular abutment afforded in the cap. This prevents the cover from being removed when the latter is being pulled along said axial direction and thus prevents access to the underlying cap. To enable the capsule to be screwed back on the container, the outer cover comprises a projection that projects inwardly and that can interact with a protrusion that projects outwardly from the cap. In a plane perpendicular to an axis of cylindrical symmetry of the container, a section of this protrusion is shaped in the form of a right-angled triangle. When the cover turns in a direction for tightening the capsule, the projection intercepts a leg of this right-angled triangle, enabling transmission of motion from the cover to the cap and thus closure on the container. When the cover turns in a direction opposite the tightening direction (corresponding to the direction for opening the container), said projection intercepts the hypotenuse of the above-mentioned right-angled triangle, which therefore, owing to its inclination, constitutes a guide for the cover to slide freely with respect to the cap (as described above for enabling the opening thereof, in addition to turning the cover, axial pushing of the cover towards the cap is in fact needed to enable meshing of the cap and cover). One drawback of this solution relates to the fact that sometimes when the capsule is being screwed back on the container, as the protrusion indicated hereinabove (cross-sectionally shaped in the form of a right-angled triangle) interacts with the above-mentioned projection (having a cross section that is less sturdy), it breaks it or forces it to turn over, making it useless. This obviously impairs proper functioning of the capsule.

DISCLOSURE OF THE INVENTION

In this context, the technical task underlying the present invention is to offer a safety capsule that overcomes the above-mentioned drawbacks of the prior art.

In particular, an aim of the present invention is to make available a safety capsule that makes it possible to minimize the risk of the capsule malfunctioning. The defined technical task and the specified aims are substantially achieved by a safety capsule comprising the technical characteristics set forth in one or more of the appended claims.

BRIEF DESCRIPTION OF DRAWINGS

Further characteristics and advantages of the present invention will become more apparent from the approximate and thus non-limiting description of a preferred, but not exclusive, embodiment of a capsule as illustrated in the accompanying drawings, of which.

DETAILED DESCRIPTION OF PREFERRED EMBODIMENTS OF THE INVENTION

Figure 1:
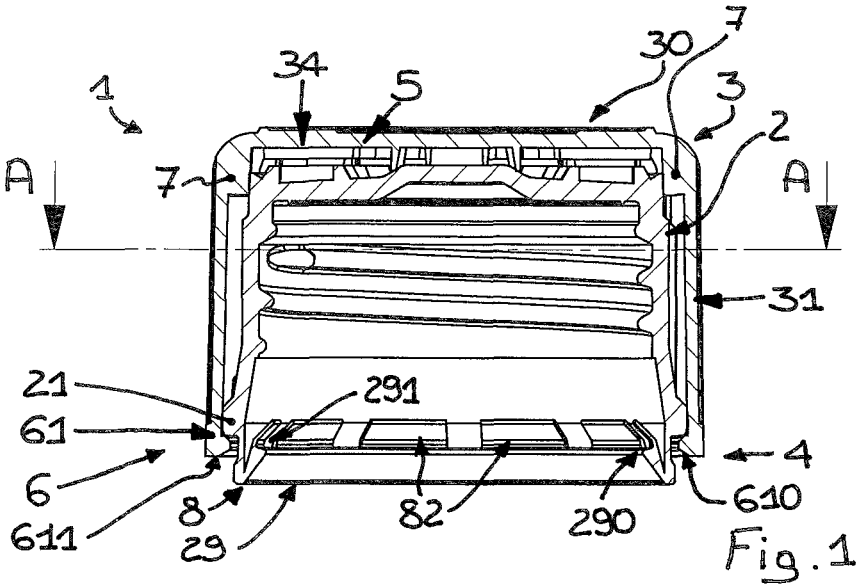
FIG. 1 is a sectional view of a capsule according to the present invention.
Figure 2:
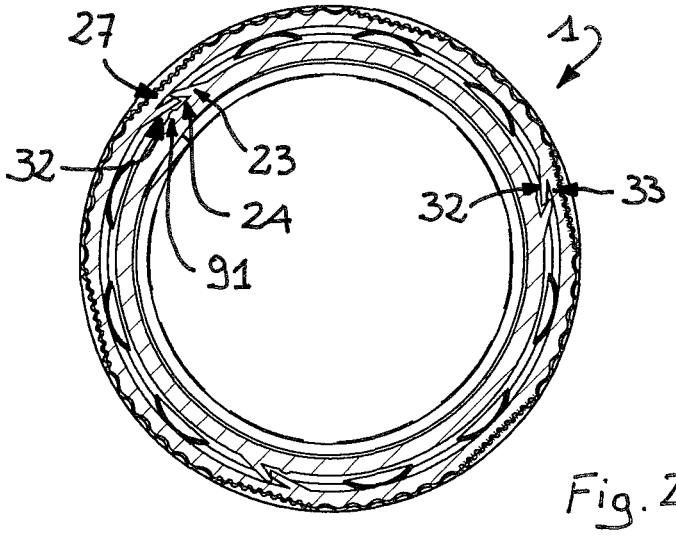
FIG. 2 is a view of the capsule along the section plane A-A of FIG. 1.
Figure 3:
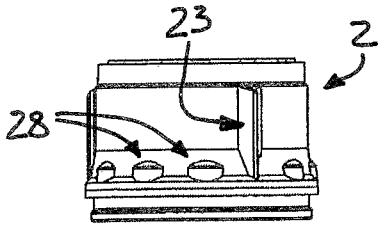
FIG. 3 is a side view of a component of the capsule of FIGS. 1 and 2.
Figure 5:
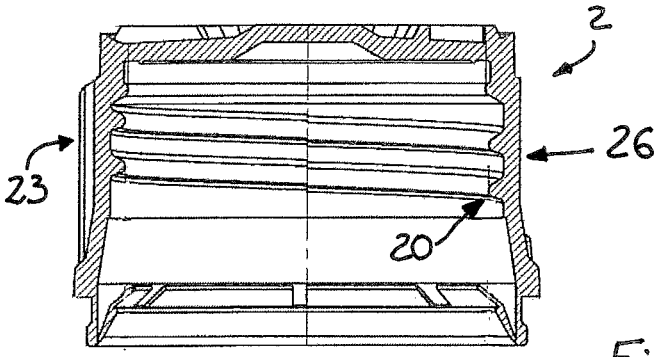
FIG. 5 is a sectional view along the plane B-B of FIG. 4.
Figure 4:
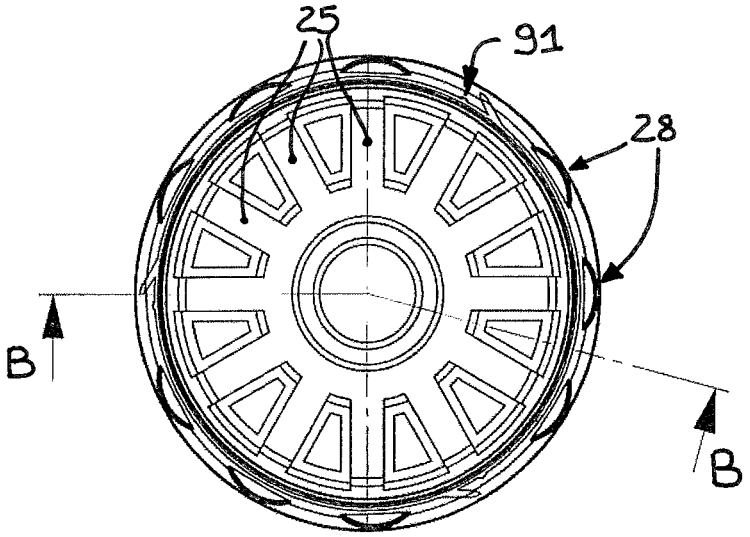
FIG. 4 is a top view of the component appearing in FIG. 3.

A safety capsule (also known in the art as a childproof capsule) for a container is indicated by the reference number "1" in the attached figures. This safety capsule 1 is utilized to enable the opening and closing of a mouth of a container, but also to prevent accidental access to the contents of the container (for example on the part of a child). This capsule 1 is typically applied to the neck of a container. In particular, it is used for pharmaceutical applications.

This capsule 1 comprises a cap 2 for closing the container. The cap 2 comprises a thread 20 for connection to the container. This thread 20 enables the cap 2 to be screwed onto the container so as to enable the closure thereof and to be unscrewed from the container so as to enable extraction of the product contained therein.

The capsule 1 conveniently comprises a cover 3 for said cap 2. The cover 3 comprises a base 30 and a lateral wall 31 that extends from said base 30. Conveniently, the cover 3 consists of a single body. The base 30 and the lateral wall 31 overlie the cap 2. The base 30 is at the opposite end with respect to a zone 4 of the capsule that comprises an intactness band 8 designed to be connected with the container (this intactness band 8 makes the capsule 1 tamper-evident).

The intactness band 8 is connected to remaining parts of the cap 2 by means of flexible bridges. Prior to breakage, the bridges connect the band 8 to remaining parts of the cap 2. The intactness band 8 comprises a strip 29 and a plurality of projections 82, which:

are separated from each other and extend from the strip 29 in succession side by side along a circumferential line;

project towards the inside of the capsule 1 and together with the strip 29, define a step 290 that identifies a seat 291 for housing part of the container (this seat 291 allows a part of the container known in the technical jargon as a "bague" to be received).

The cap 2 is preferably made of a plastic material, for example polypropylene or HDPE. The cover 3 is preferably made of a plastic material, for example polypropylene or HDPE.

The capsule 1 comprises a press-fit engagement means 5 that sets said cap 2 and said cover 3 into operative communication, enabling transmission of motion from the cover 3 to the cap 2 for the purpose of making it possible to unscrew said cap 2. If the press-fit engagement means 5 is not activated and a user attempts to unscrew the capsule 1 from the container, the cover 3 turns freely without meshing with the cap 2. The press-fit engagement means 5 is at least partly incorporated in said cap 2 and in said cover 3. In particular, the press-it engagement means 5 can comprise tabs 34 fashioned as a single piece with the remaining parts of the cover 3 that are inserted in specific seats 25 afforded in the cap 2. In particular, the tabs 34 are afforded in the base 30 of the cover and they are advantageously arranged radially.

The capsule 1 further comprises means 6 for preventing extraction of the cover 3 from the cap 2. The extraction prevention means 6 performs an action that prevents separation of the cover 3 from the cap 2 following application of a force directed perpendicularly to the base 30. This extraction prevention means 6 comprises a first connecting means 61 for connecting the cover 3 to the cap 2 and that extends along a first imaginary annular line.

The first connecting means 61 is at least partly incorporated in said cap 2 and cover 3.

The first connecting means 61 comprises a protrusion that interacts with a corresponding abutment, said protrusion and said abutment being afforded one on the cap 2 and the other on the cover 3 (and advantageously being looped annular elements). More specifically, the first connecting means 61 comprises:

a first protrusion 611 that projects from the lateral wall 31 of the cover 3 towards said cap 2; conveniently the first protrusion 611 coincides with a first connecting ring 610 and this first connecting ring 610 is looped and lies in a plane, which advantageously extends parallel to the base 30 (however, in an unillustrated alternative solution, the first protrusion could also extend along a first imaginary line with a break in continuity);

a first abutment 21 of said first protrusion 611; said first abutment 21 is incorporated in the cap 2 and interposed between said first protrusion 611 and the base 30.

The first abutment 21 is an annular (loop) protrusion that projects towards the cover 3, particularly towards the lateral wall 31 of the cover 3.

With respect to a capsule 1 that is screwed onto a container that is resting with its support base on a surface, the first connecting ring 610 is inserted under the first abutment 21.

The first ring 610 extends parallel to a support plane of the container to which the capsule 1 is constrained.

Conveniently, the first connecting means 61 does not comprise threaded connecting means. More generally, the cover 3 and the cap 2 cannot be separated.

The cap 2 comprises a flank 26 that faces the lateral wall 31 of the cover 3. The flank 26 and the lateral wall 31 are without additional extraction prevention means (with respect to the connecting means 61) that keep the cover connected to the cap (therefore, there are no other means additional to the means 61 that oppose a cap-cover extraction force applied axially along a direction perpendicular to the base 30).

The cover 3 comprises teeth 7 located in the zone connecting said base 30 and said lateral wall 31. The teeth 7 face, and particularly abut, the cap 2. The teeth 7 contribute to keeping the cap 2 in position with respect to the cover 3. In fact, the teeth 7 contribute to keeping the cap 2 coaxial with the cover 3, particularly with the base 30.

The capsule 1 also comprises means 27 for re-closing the cap on the container after it has been opened and this means is partly incorporated in the cap 2 and partly incorporated in the cover 3. In particular, the means 27 comprises a first tab 23 projecting towards the lateral wall 31 of the cover 3. The first tab 23 is flexible. It is incorporated in the cap 2. The first tab 23 surmounts a part of the cap 2, a first concavity 23 being wedged between the first tab 23 and said part of the cap 2 (the first concavity 24 is a recess, an empty space that gives the first tab 23 flexibility). In particular, the first tab 23 forms an angle of less than 50° with the surface of the cap 2 from which it extends. Conveniently, at the opening of the first concavity 24, the cap 2 comprises a ridge 91. This ridge 91 extends towards the cover 3. The ridge 91 serves an important function, given that it counteracts the bending of the second tab 32 as it is being pushed by the first tab 23. In fact, the ridge 91 abuts the upper part of the second tab 32, increasing the stiffness thereof. The ridge 91 extends alongside the first tab 23. In particular, the ridge 91 can extend parallel to a zone for connecting the first tab 23 with remaining parts of the cap 2.

Advantageously, the thickness of the first tab 23 is less than 1 millimetre. It has a tapered shape starting from a zone connecting with remaining parts of the cap 2 and directed towards its own projecting end.

The means 27 comprises a second tab 32 that projects from the lateral wall 31 of the cover 3 towards the cap 2. The second tab 32 is flexible. The second tab 32 surmounts one zone of the lateral wall 31 of the cover, a second concavity 33 being wedged between said second tab 32 and said zone of the lateral wall 31 (this second cavity 33 is a recess, an empty space that gives the second tab 32 flexibility). In particular, this second tab 32 defines an angle of less than 50° with the lateral wall 31 of the cover 3. Conveniently, at the opening of the second concavity 33, there can be a ridge (unillustrated) that projects towards the cap 2 from the lateral surface 31 of the cover 2.

Advantageously, the thickness of the second tab 32 is less than 1 millimetre. It has a tapered shape starting from a zone connecting with remaining parts of the cover 3 and directed towards its own projecting end. The first and the second tabs 23, 32 form an angle different from 0 with respect to a radial direction (in other words, they are not oriented radially with respect to an axis oriented perpendicular to said base 30 and passing through the geometric centroid of the capsule 1). The inclination of the first and the second tabs 23, 32 allows for a secure connection between the cap 2 and container 3, in spite of the fact that the presence of the first connecting means 61 brings about a reduction in the extension of the first and the second tabs 23, 32 along said axial direction. In fact, the first and the second tabs 23, 32 are located above the first connecting means 61.

A first direction of rotation of the cover 3 determines the simultaneous insertion of the first tab 23 in the second concavity 33 and the insertion of the second tab 32 in the first concavity 24. The first direction of rotation is such as to determine closure of the capsule 1. In fact, the first direction of rotation enables the transmission of motion from the cover 3 to the cap 2, and the cap 2 to be screwed onto the container.

A second direction of rotation of the cover 3 determines the sliding of the first tab 23 over the second tab 32 (without insertion in the second concavity; in this case, the upper parts of the first and the second tabs 23, 32 slide one over the other). This second direction of rotation is opposite the first direction of rotation. The second direction of rotation is the same direction of rotation that determines the unscrewing of the cap 2 from the container in the case in which the press-fit engagement means 5 is activated.

Conveniently, the first and the second tabs 23, 32 extend predominantly along a direction perpendicular to said base 30 of the cover 3. In other words, the first and the second tabs 23, 32 predominantly extend in a vertical direction with respect to a capsule screwed onto a container that is resting with its support base on a surface.

The second tab 32 involves more than half of the height of the lateral wall 31 of the cover 3. The first tab 23 involves more than half of the height of the cap 2.

The cap 2 comprises a plurality of convex elements 28 that project towards said lateral wall 31 and that function as lateral cover-cap spacers. These convex elements 28 are distributed circumferentially.

Advantageously, the cap 2 comprises a plurality of first tabs 23. The description provided with reference to the first tab 23 can be repeated for said plurality of first tabs 23.

In particular, the first tabs 23 are flexible, incorporated in the cap 2, project towards the lateral wall 31 of the cover 3 and, with the surface of the cap 2 from which they extend, they form first concavities 24.

Likewise, the cover 3 comprises a plurality of second tabs 32. The description provided with reference to the second tab 32 can be repeated for said plurality of second tabs 32.

The second tabs 32 are flexible, project from the lateral wall 31 of the cover 3 towards the cap 2 and, with the lateral wall 31 of the cover 3, they define second concavities 33.

A first direction of rotation of the cover 3 determines the simultaneous insertion of the first tabs 23 in the corresponding second concavities 33 and the insertion of the second tabs 32 in the corresponding first concavities 24, so as to enable transmission of motion from the cover 3 to the cap 2, and the cap 2 to be screwed onto the container. A second direction of rotation of the cover 3 determines the sliding of the first tabs 23 over the second tabs 32.

The first and the second tabs 23, 32 conveniently define at least three pairs of mutually cooperating tabs.

In a configuration in which the band 8 is intact, said cap 2 is a single monolithic body. The band 8, the first tab(s) 23 and a portion of the cap 2 that faces said base 30 are thus part of the monolithic body. The object of the present invention is also a method for producing a capsule 1 having one or more of the characteristics described hereinabove.

The method conveniently comprises the steps of:

realizing said cap 2;

realizing said cover 3;

inserting the cap 2 into the cover 3.

The step of realizing said cap 2 comprises:

obtaining a raw piece by moulding;

making cuts through said raw piece so as to realize said connection bridges, said bridges being suitable for breaking when the capsule 1 is being opened;

bending back towards the inside of the capsule 1, part of the strip 29 and the projections 82 projecting from said strip 29.

The invention thus conceived makes it possible to achieve multiple advantages.

In particular, the invention makes it possible to make available a particularly reliable capsule that makes it possible to minimize undesired breakage of the first tabs 23 which could be detrimental to proper functioning of the capsule.

The invention thus conceived is susceptible to numerous modifications and variants, all of which falling within the scope of the inventive concept characterizing the invention. Moreover, all details may be replaced with other technically equivalent elements. All the materials used, as well as the dimensions, may in practice be of any type, according to needs.

The invention claimed is:

1. A safety capsule for a container, comprising:

i) a cap (2) for closing the container, said cap (2) being made of a plastic material and comprising a thread (20) for connection to the container;

ii) a cover (3) for said cap (2), said cover (3) comprising a base (30) and a lateral wall (31) that extends from said base (30); said base (30) and said lateral wall (31) overlying said cap (2), said base (30) being at the opposite end with respect to a zone (4) of the capsule in which an intactness band (8) is located; the intactness band (8) being designed to be connected with the container;

iii) a press-fit engagement means (5) that sets said cap (2) and said cover (3) into operative communication, enabling transmission of motion from the cover (3) to the cap (2) for a purpose of making it possible to unscrew said cap (2);

iv) means (6) for preventing extraction of the cover (3) from the cap (2), comprising a first connecting means (61) for connecting the cover (3) to the cap (2); said engagement means (5) and said first connecting means (61) being at least partly incorporated in said cap (2) and cover (3);

v) means for re-closing the cap on the container after it has been opened, comprising:

at least a first flexible tab (23) incorporated in the cap (2) and projecting towards the lateral wall (31) of the cover (3); said first tab (23) surmounting a first part of the cap (2), a first concavity (24) being wedged between the first tab (23) and said first part of the cap (2);

a second flexible tab (32) projecting from the lateral wall (31) of the cover (3) towards the cap (2); the second tab (32) surmounting one zone of the lateral wall (31) of the cover, a second concavity (33) being wedged between said second tab (32) and said zone of the lateral wall (31);

a first direction of rotation of the cover (3) determining a simultaneous insertion of the first tab (23) in the second concavity (33) and an insertion of the second tab (32) in the first concavity (24) so as to enable the transmission of motion from the cover (3) to the cap (2), and the cap (2) to be screwed onto the container as a result;

a second direction of rotation of the cover (3) determining a sliding of the first tab (23) over the second tab (32).

2. The capsule according to claim 1, characterized in that said cap (2) comprises a flank (26) that faces the lateral wall (31) of the cover (3), said flank (26) and said lateral wall (31) being without additional extraction prevention means that keep the cover connected to the cap.

3. The capsule according to claim 1, characterized in that said cover (3) is made of polypropylene.

4. The capsule according to claim 1, characterized in that:

the first tab (23) forms an angle of less than 50° with a surface of the cap (2) wherefrom it extends, so as to define the first concavity (24);

the second tab (32) defines an angle of less than 50° with the lateral wall (31) of the cover (3), so as to define the second concavity (33).

5. The capsule according to claim 1, characterized in that a predominant extension of the first and the second tabs (23, 32) is along a direction perpendicular to said base (30) of the cover (3);

the second tab (32) involving more than half of the height of the lateral wall (31) of the cover (3);

said first tab (23) involving more than half of the height of the cap (2).

6. The capsule according to claim 1, characterized in that the cap (2), at the opening of the first concavity (24), comprises a ridge (91) that extends towards the cover (3) so as to counteract possible bending of the second tab (32) as it is being pushed by the first tab (23).

7. The capsule according to claim 1, characterized in that said cap (2) comprises a plurality of convex elements (28) that project towards said lateral wall (31) and that function as lateral cover-cap spacers.

8. The capsule according to claim 1, characterized in that said first connecting means (61) comprises:

a first protrusion (611) that projects from the lateral wall (31) of the cover (3) towards said cap (2), said first protrusion (611) comprising a first ring (610) that is seamless;

a first abutment (21) of said first protrusion (611), said first abutment being incorporated in the cap (2) and interposed between said first protrusion (611) and the base (30).

9. The capsule according to claim 1, characterized in that said intactness band (8) is connected to remaining parts of the cap (2) by means of flexible bridges, said intactness band (8) comprising a strip (29) and a plurality of projections (82), which:

are separated from each other and extend from the strip (29) in succession side by side along a circumferential line;

project towards the inside of the capsule (1) and together with the strip (29), define a step (290) that identifies a seat (291) for housing part of the container.

10. The capsule according to claim 1, characterized in that the cap (2) comprises the intactness band (8) which is designed to be connected with the container; in a configuration wherein the band (8) is intact, said cap (2) being a single monolithic body.

* * * * *